US008678709B2

(12) United States Patent
Utz et al.

(10) Patent No.: US 8,678,709 B2
(45) Date of Patent: Mar. 25, 2014

(54) SECURITY NET ON WATER OR ON THE GROUND

(75) Inventors: Peter Utz, Allensbach (DE); Stephan Wartmann, Uttwil (CH)

(73) Assignee: Geobrugg AG, Romanshorn (CH)

( * ) Notice: Subject to any disclaimer, the term of this patent is extended or adjusted under 35 U.S.C. 154(b) by 0 days.

(21) Appl. No.: 13/384,354

(22) PCT Filed: Jul. 12, 2010

(86) PCT No.: PCT/EP2010/004230

§ 371 (c)(1),
(2), (4) Date: Jan. 17, 2012

(87) PCT Pub. No.: WO2011/009542

PCT Pub. Date: Jan. 27, 2011

(65) Prior Publication Data

US 2012/0121342 A1 May 17, 2012

(30) Foreign Application Priority Data

Jul. 24, 2009 (CH) ..... 1175/09

(51) Int. Cl.
*E02B 15/06* (2006.01)
*E01F 7/04* (2006.01)

(52) U.S. Cl.
USPC ..... 405/72; 405/63; 405/26; 405/27; 405/302.7; 256/12.5; 256/13

(58) Field of Classification Search
USPC ..... 405/302.7, 302.6, 302.4, 115, 107, 15, 405/16, 17, 21, 26, 27, 34, 35, 60, 63, 72; 256/12.5, 13, 32, 33, 35, 42, 45
See application file for complete search history.

(56) References Cited

U.S. PATENT DOCUMENTS

| | | | | | |
|---|---|---|---|---|---|
| 1,819,305 | A | * | 8/1931 | Snyder | 405/32 |
| 1,969,123 | A | * | 8/1934 | Doble | 405/28 |
| 2,092,183 | A | * | 9/1937 | Rehfeld | 405/19 |
| 2,135,337 | A | * | 11/1938 | Herbest, Jr. | 405/32 |
| 4,136,994 | A | * | 1/1979 | Fuller | 405/27 |
| 4,335,868 | A | | 6/1982 | Ribbert | |
| 4,526,347 | A | | 7/1985 | McLoughlin | |
| 4,710,057 | A | * | 12/1987 | Laier | 405/30 |
| 4,947,791 | A | * | 8/1990 | Laier et al. | 405/26 |
| 4,954,013 | A | * | 9/1990 | Lamberton | 405/25 |
| 5,039,250 | A | * | 8/1991 | Janz | 405/302.6 |
| 5,605,416 | A | * | 2/1997 | Roach | 405/21 |
| 6,279,858 | B1 | | 8/2001 | Eicher | |
| 6,497,532 | B1 | * | 12/2002 | McGinn | 405/27 |
| 6,551,031 | B2 | | 4/2003 | Van Ornum | |

(Continued)

*Primary Examiner* — Frederick L Lagman
(74) *Attorney, Agent, or Firm* — Brian Roffe

(57) ABSTRACT

According to the invention, a security net can be erected in or on water or on the ground and is provided with a net or net-like structure (1) manufactured substantially from wire material, rope material, strand material or plastics material (2). The net (1) is bent together and forms longitudinal flanks (3, 4) and at least one arched region (5). The overlapping longitudinal flanks (3, 4) can be connected together and several stabilizers (8) are associated with the net (1). In cross-section, the net (1) is constructed similarly to a teardrop, with the arched region (5) lying on or at least partially in the water. In this way, a largely double-walled security system is obtained, which is able to intercept impacting objects reliably and moreover gently, because the net and the three-dimensional protective net structure is deformable due to the relative flexibility thereof.

18 Claims, 3 Drawing Sheets

(56) References Cited

U.S. PATENT DOCUMENTS

| | | | | |
|---|---|---|---|---|
| 6,681,709 | B1 | 1/2004 | Nixon et al. | |
| 6,789,979 | B1 | 9/2004 | Jones | |
| 6,824,681 | B2 * | 11/2004 | Engwer | 405/302.7 |
| 6,910,835 | B2 * | 6/2005 | Spangler et al. | 405/302.6 |
| 6,921,484 | B2 * | 7/2005 | Engwer | 405/302.7 |
| 6,960,047 | B2 * | 11/2005 | Knezek et al. | 405/35 |
| 6,986,624 | B1 | 1/2006 | Tabler | |
| 7,048,474 | B2 * | 5/2006 | Tabler | 405/302.7 |
| 2003/0010968 | A1 * | 1/2003 | Hendrickson | 256/12.5 |
| 2004/0164285 | A1 * | 8/2004 | Bernasconi | 256/12.5 |
| 2006/0263151 | A1 * | 11/2006 | McMahon | 405/302.6 |
| 2007/0080331 | A1 * | 4/2007 | Roth | 256/12.5 |
| 2009/0230373 | A1 | 9/2009 | Helseden | |

* cited by examiner

SECURITY NET ON WATER OR ON THE GROUND

FIELD OF THE INVENTION

The invention relates to a security net which can be erected in water or on the ground, comprising a net manufactured in particular from a wire mesh.

BACKGROUND OF THE INVENTION

Such security nets and barriers are used, for example, for blocking off bodies of water, for example in order to prevent water vehicles and other undesired objects from passing into certain areas of the body of water. It is also known to use such barriers as barricades to protect against rock fall, landslides, mudslides, avalanches, snow slides and similar natural dangers.

Such barriers are likewise used for barricades and blockades in the domain of police, border or personal security to protect against aggressive vehicle attacks in the security domain or against tenor risks or on land.

With the barriers of this type known until now the net is stretched to form a single wall and is fastened to supports which are anchored in the solid ground. Such a barrier is very complex to construct and set up and, since it is installed securely at the intended site, it can not be used again for other requirements. Moreover, it is a disadvantage that the stretched net can only absorb limited impact energy, and in individual cases this results in partially irreparable damage to the impacting object and also, in some cases, to the whole barrier.

OBJECTS AND SUMMARY OF THE INVENTION

The object underlying the invention is to avoid these disadvantages and to provide a security net of the type specified at the start which is particularly easy to set up and take down, which has a high retaining capacity and the structure of which can easily be adapted to the respective conditions of use.

According to the invention, this object is achieved by a security net that can be erected in or on water or on the ground and includes a net or net-like structure manufactured substantially from wire material, rope material, strand material or plastic, and which net is bent together and forms at least one arched region, and also has stabilizers preferably assigned to the net.

In this way one obtains a largely double-walled security system which is able to intercept impacting objects reliably and, moreover, gently because the net and the three-dimensional protective net structure is deformable due to its relative flexibility.

Assembly is implemented by partially or completely bending together the pre-fabricated wire mesh to form a structure with a preferably teardrop-shaped, round, oval or teardrop-like cross-section and/or with some other type of prismatic cross-section shape with overlapping and interconnected longitudinal flanks. This produces a support-free structure which can be assembled in situ and adapts easily to the respective spatial conditions due to its flexibility.

The security net is held in or on the arched region with stabilisers which are easy to fit and remove. Depending on the type of connection, this arched region can also be polygonal, arched or similar in form, in the following this region always being referred to overall as the arched region.

The stabilisers can also be easily removed in reverse sequence. Depending on the application these stabilisers can be made of different materials and are of different forms and constructions depending on the purpose.

The stabilisers can also include additionally attached elements in order to reinforce the net structure which then, for example, perform additional internal or external bracing or support functions.

In order to facilitate assembly and removal of the barrier it is advantageous to connect the longitudinal flanks of the net to one another with easily detachable fastening elements. According to the invention the latter are arranged in a row along the longitudinal flanks a distance away from the longitudinal edges of the latter. In this way the rigidity of the structure is increased without having any negative impact upon the deformability of the latter in the impact region. In order to further increase the rigidity it is advantageous to provide additional fastening elements in the overlapping flank region and/or along the longitudinal edges. Depending on the application such elements can also be used in curved regions or at breaks in the line of the structure.

In order to improve the dimensional stability of the net without reducing its overall flexibility provision is made according to the invention such that the net is provided with loops arranged distributed in the longitudinal direction and made of a wire rope, stranded rope, wires, strips, bars, flat steel or the like guided through the meshes of the net, it also being possible to use combinations of the latter.

Within the context of simple assembly and removal of the net it is advantageous if the loops are connected to the longitudinal flanks of the net with easily detachable fastening elements, preferably shackles or other easily opening and closing elements.

Likewise, a round, oval or similar largely closed embodiment of the prismatic longitudinal body is also a possible form for this barrier. In this embodiment a number of stabilisers can be fitted. The number of overlapping elements can be reduced to 1 or no element.

As alternative applications constructions countering snow slides and avalanches are also possible. With these applications the teardrop-shaped structure lies on the sloping ground and is preferably anchored point by point at the overlapping elements. The stabilisers then lie or respectively stand at a certain angle to the surface of the ground. Retention of quantities of snow in the region of the break can thus also be provided.

This security net according to the invention can be used in bodies of water, either in open bodies of water, offshore or in closed bodies of water such as ports and similar constructions. Applications can take place in standing, streaming or also flowing bodies of water. In this case the invention makes provision such that the net is laid floating in the water and is provided in the arched region with floating bodies preferably arranged laterally to the longitudinal direction as stabilisers. It is advantageous here if the floating bodies are held with pipe clamps which are provided with clamping brackets securely clamping the meshes of the wire mesh.

The barrier according to the invention can also be erected on solid ground, for example as a vehicle barrier or as a fence protecting against natural dangers such as rock fall, landslides, avalanches and similar dangers. There are also applications for barriers and for blockades against vehicles or criminal or terrorist attacks, break-ins or break-outs. In these cases the invention makes provision such that the net is provided in or at the arched region with stabilisers in the form of fixing elements arranged distributed in the longitudinal direction.

In a first version provision is made such that loose concrete blocks or similarly heavy bodies, spaced apart from one another, are used as fixing elements. Instead of concrete blocks, other loads or weights are also possible, such as for example filled sacks or plastic elements, water or sand preferably being used as the filler material. It is also possible, however, to optionally fill the whole net structure partially or totally with, for example, soil, earth or stone materials. Short anchorings of the teardrop-shaped structure, advantageously with security nets only installed for a short period of time, are also conceivable.

In another version, instead of the concrete blocks fastening plates or elements spaced apart from one another and anchored in the ground are provided. In this way one can easily adapt the fixing of the net to the respective conditions of use from case to case.

According to the invention the wire mesh for the net is produced as a spiral rope mesh made of corrosion-resistant, high strength steel wire with diamond-shaped meshes and a three-dimensional, mattress-like structure. Such a mesh can withstand high stresses in the long term. On the other hand, due to its elasticity on all sides it is deformable to a considerable extent. The net thus achieves the sought after intercepting effect. Moreover, the barrier profile can easily be adapted to the respective conditions of use.

The actual net is produced from rope, wire, strand, thread, filament elements or similar basic products, and is substantially made by steel, metal, plastic and/or combination production. The mesh shapes of the nets can also be configured to be rectangular, square, rhomboid, hexagonal, round or in some other form.

The net should preferably have a certain inherent rigidity and, moreover, be three-dimensional in form.

The net structure can be strengthened by additional longitudinal or surface elements arranged point by point or also two-dimensionally. Depending on the application, these elements can also additionally include brake elements for absorbing energy.

The effective height or depth of the net structure can be increased by introducing clip-on brackets or similar elements.

The hollow spaces and gaps in the protective net structure can be partially or totally filled depending on the application. For example, filling with earth or stone material can greatly increase the static and dynamic properties of the barrier.

BRIEF DESCRIPTION OF THE DRAWINGS

In the following the invention is described in greater detail using three exemplary embodiments with reference to the drawings. These show as follows.

DETAILED DESCRIPTION OF THE INVENTION

Figure 1:
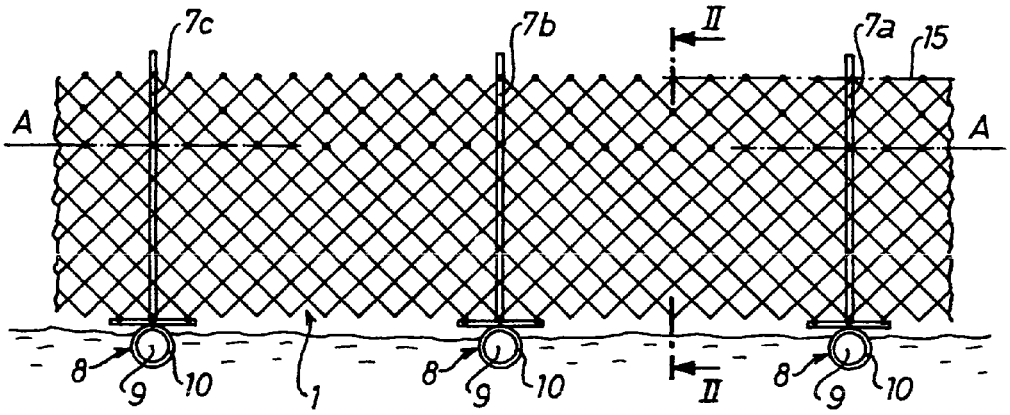
FIG. 1 is a front view of a first version of a security net according to the invention, laid floating in a body of water, illustrated diagrammatically.
Figure 2:
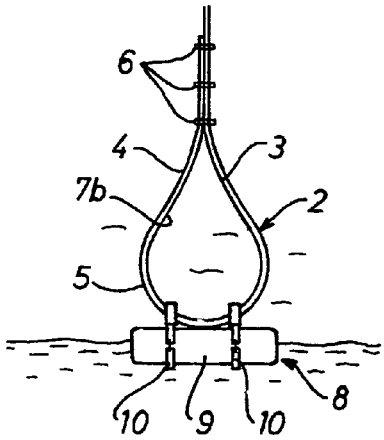
FIG. 2 shows the security net from FIG. 1, shown in a section along line II-II in FIG. 1.
Figure 3:
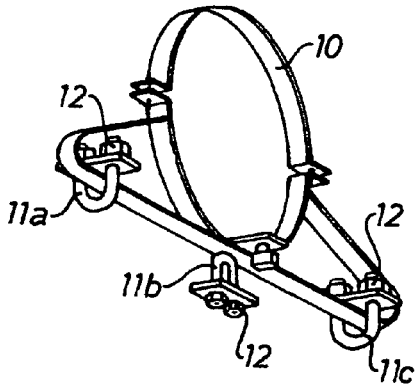
FIG. 3 shows a pipe clamp for this net from FIG. 1, enlarged and shown perspectively.

The net 1 shown in FIG. 1 and FIG. 2 is produced from an originally flat wire mesh 2 that is bent together in the longitudinal direction and the longitudinal flanks 3 and 4 of which overlap between the longitudinal edge 15 and a parallel line A-A lying over the latter.

The wire mesh 2 is in the form of a spiral rope mesh with diamond-shaped meshes. The diagonals of the latter are aligned in the longitudinal and lateral direction of the net so that the latter can extend in both directions in order to intercept the impacting object well when there is an impact. The mesh has a three-dimensional, mattress-like structure, as disclosed in publication WO-A-99/43894, which corresponds to U.S. Pat. No. 6,279,858.

According to the invention the net 1 is bent together and thereby forms longitudinal flanks 3, 4 and an arched region 5, it being possible to connect the overlapping longitudinal flanks 3, 4 to one another and stabilisers 8 being assigned to the net 1 in the arched region 5.

The net flanks 3 and 4 are connected detachably along line A-A and the longitudinal edge 15 with fastening means in the form of rustproof clamping brackets 6. Further clamping brackets 6 are arranged within the overlapping surface of the net flanks. The surface connection provides the net with a certain degree of rigidity in the longitudinal plane of the net which contributes to the net remaining stable in the assembled state.

In order to further increase the dimensional stability of the net, the net has loops 7*a*, 7*b*, 7*c* arranged distributed in the longitudinal direction, which are drawn through the meshes of the wire mesh 2 laterally to the longitudinal direction, and are fastened at the ends by means of the clamping brackets 6. By taking this measure the sought-after intercepting effect of the net is supported.

The net 1 is provided in the arched region 5 with stabilisers 8 which hold the position of the net in the body of water stable without its deformability being impaired in the event of impact. The stabilisers 8 are in the form of cylindrical floating bodies 9 which are fastened to the wire mesh 2 lateral to the longitudinal direction of the net.

Pipe clamps 10 with clamping brackets 11*a*, 11*b*, 11*c* are used as fastening elements for holding the wire meshes. The latter are clamped securely by tightening the screw connections 12 at the ends of the clamping brackets. The construction described facilitates both the fastening of the pipe clamps 10 to the wire mesh 2 and removal of said clamps when taking down the barrier.

As can be seen in FIG. 2, the floating bodies 9 are each secured by two pipe clamps 10 lateral to the longitudinal direction of the net, and this is associated with a greater stabilisation effect. Within the framework of the invention it is needless to say possible to vary the configuration and arrangement of the floating bodies from case to case, and to fix them depending on the respective conditions of use.

Figure 4:
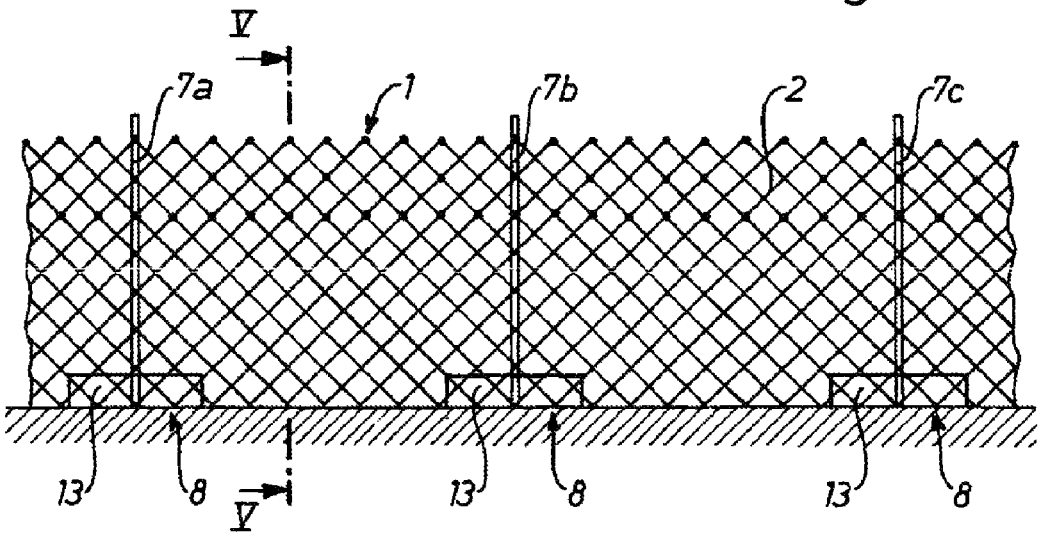
FIG. 4 is a front view of a second version of a security net according to the invention, erected on solid ground and illustrated diagrammatically.
Figure 5:
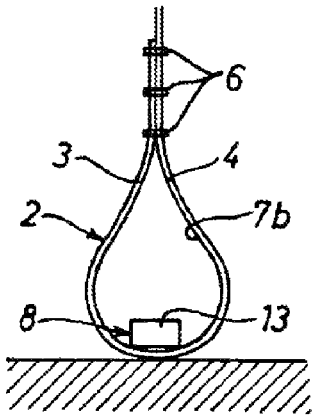
FIG. 5 shows the security net from FIG. 4, illustrated as a section along line V-V in FIG. 4.
Figure 6:
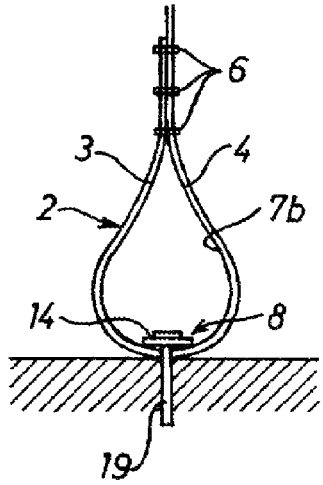
FIG. 6 shows a third version of a security net according to the invention, also erected on solid ground, illustrated as a section and diagrammatically.

The barrier according to FIG. 4 to FIG. 6 is erected on solid ground, the net 2 in the version according to FIG. 4 and FIG. 5 being weighted down with concrete blocks 13 arranged in the arched region distributed in the longitudinal direction as fixing elements. The latter are also arranged here in the region of the loops 7*a*, 7*b*, 7*c*. However, they can of course be distributed with smaller or larger intermediate spaces depending on the conditions of use. The point by point arrangement of the stabilisers facilitates adaptation of the barrier extension to the spatial circumstances. Moreover, assembly and dismantling of the barrier is very easy.

The net can be assembled in situ, starting with a rolled-up wire mesh which takes up relatively little space and so is easy to transport. The wire mesh is rolled out in situ, bent over, and tightened and fixed at the top. The concrete blocks 13 are erected over the rolled-out net before bending over the mesh. They can also only be erected after bending over the net before tightening and fixing the net flanks. Instead of concrete blocks, sand bags and similar heavy bodies can also be used.

In the version according to FIG. 6 fastening plates 14 are provided as fixing elements which are anchored by anchorings 19 knocked into the ground. Their distribution along the net corresponds to the arrangement provided for the concrete blocks 13.

Figure 7:
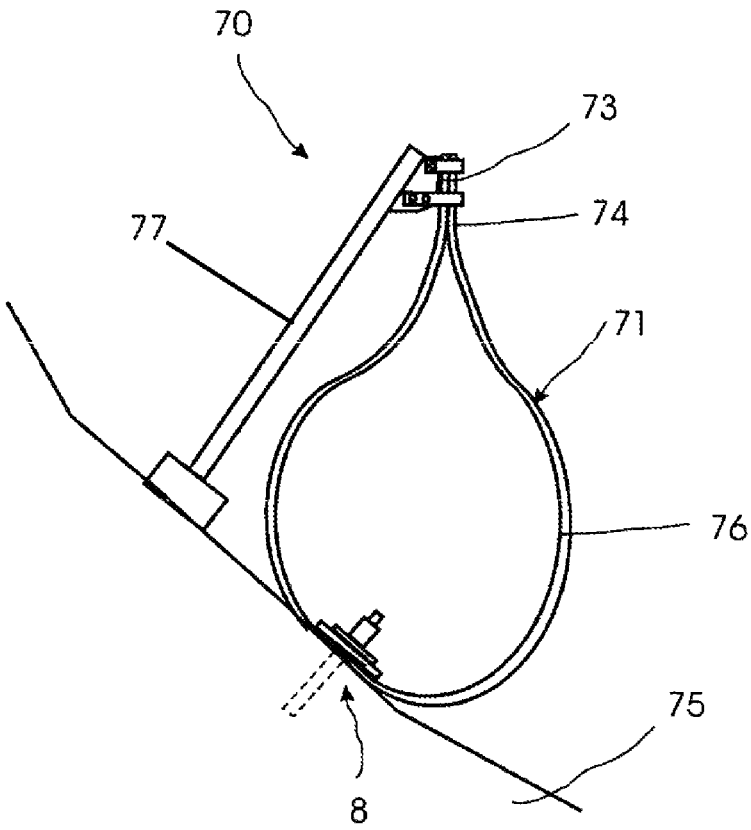
FIG. 7 is a diagrammatic side view of a security net according to the invention for protection again avalanches and rock fall.

FIG. 7 shows a security net 70 according to the invention which in itself is configured in the same way as those according to FIG. 4 to FIG. 6. It is especially suitable, however, as a net protecting against avalanches and rock fall, and so is installed on a sloping hillside 75. A bent together net 71 is fixed with its arched region 76 on the hillside by means of stabilisers 8 as anchorings, and the upwardly aligned longitudinal flanks 73, 74 of the net 71 are advantageously held at a number of supports 77 positioned distributed over the length of the net via indicated fastening means which are also anchored in the hillside 75 in a conventional manner.

Figure 8:
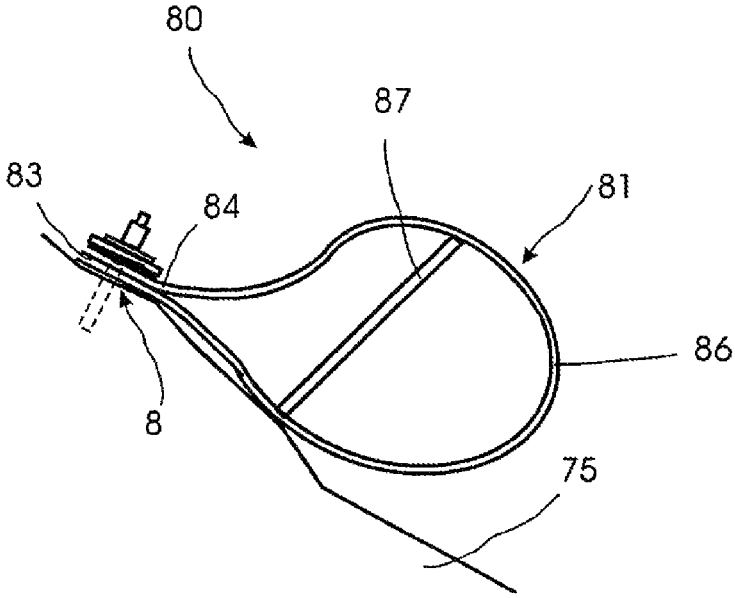
FIG. 8 is a diagrammatic side view of a further version of a security net for protection against avalanches and rock fall.

With the security net 80 according to FIG. 8, unlike that of FIG. 7, the bent together net 81 is held with its longitudinal flanks 83, 84 on a slope 75 with a number of stabilisers 8 anchored in the ground. Moreover, there are advantageously a number of supports 87 positioned next to one another within the arched region 86 by means of which the formed arch of the net 81 is not pressed flat when loaded, and the arch is permanently widened to the top. These supports 87 can also be anchored in the ground.

Needless to say, other fixing elements can also be used as stabilisers provided they are easy to fit and remove and enable a variable barrier arrangement that adapts to the respective spatial circumstances.

The barrier according to the invention is characterised by a support-free structure which can be assembled in situ and the relative flexibility of which produces an intercepting effect which guarantees a high degree of blocking reliability and, moreover, is gentle for impacting objects. It is also characterised by its adaptability to the respective spatial circumstances, re-usability of the net and by simple fitting and disassembly, which is also associated with economic advantages.

Likewise, the net according to the invention could also be immersed in water, the stabilisers then lying on the water, and the arched region of the net being fastened on the lower side of the stabilisers. Such applications also serve, among other things, for defence against floating and diving attacks as well as for filtering or cleaning applications to prevent the contamination of bodies of water in order to protect nature and the infrastructure.

Moreover, the invention could also be demonstrated or illustrated in other versions. The net could thus be bent to form a cylindrical cross-section preferably with or without longitudinal flanks and be rolled together one or more times here depending on the requirements. One or more round brackets surrounding the net could be provided here as stabilisers which are respectively preferably anchored in the ground or have a fixing element.

The invention claimed is:

1. A security net for erecting in or on water or on the ground, comprising:

a bendable net comprising a mesh of wire material, rope material, strand material or plastic, said net having an arched region at a bottom, and upwardly extending regions opposite one another each on a respective side of said arched region;

stabilizers engaging with said arched region and configured to exert a downward holding force on said net to maintain said net in or on water or on the ground, said stabilizers comprising oblong floating bodies oriented in a lateral direction to a longitudinal direction of said net; and connection members that engage said floating bodies with said net, each of said connection members including a pipe clamp that extends around said floating body and clamping brackets coupled to said pipe clamp and to the mesh of said net.

2. The net of claim 1, wherein said net has a cross-section which is tear-drop shaped, round, oval or polygonal.

3. The net of claim 1, wherein said regions opposite one another include longitudinal flanks of said net, said longitudinal flanks having an overlapping portion, said longitudinal flanks being detachably connected to one another along said overlapping portion.

4. The net of claim 3, further comprising fastening elements along said longitudinal flanks for detachably holding together said longitudinal flanks along said overlapping portion.

5. The net of claim 1, further comprising loops connected to said net, said loops being spaced apart from one another in a longitudinal direction of said net, each of said loops extending through the mesh of said net in a lateral direction to the longitudinal direction of said net.

6. The net of claim 5, wherein said regions opposite one another include longitudinal flanks of said net, further comprising fastening elements that removably attach said loops to said longitudinal flanks of said net.

7. The net of claim 5, further comprising fastening elements that clamp opposed portions of said loops to one another.

8. The net of claim 1, wherein the mesh comprises corrosion-resistant, high strength steel wire with diamond-shaped meshes and a three-dimensional structure.

9. The net of claim 1, wherein the mesh of said net is flat having a length and a height, said net being bent lengthwise to form said arched region.

10. A security net for erecting in or on water or on the ground, comprising:

a bendable net comprising a mesh of wire material, rope material, strand material or plastic, said net having an arched region at a bottom, and upwardly extending regions opposite one another each on a respective side of said arched region;

stabilizers engaging with said arched region and configured to exert a downward holding force on said net to maintain said net in or on water or on the ground; and loops connected to said net, said loops being spaced apart from one another in a longitudinal direction of said net, each of said loops extending through the mesh of said net in a lateral direction to the longitudinal direction of said net, each of said loops having a loop portion at a bottom and a straight portion above said loop portion.

11. The net of claim 10, wherein said stabilizers comprise fixing elements distributed in a longitudinal direction of said net.

12. The net of claim 11, wherein at least one of said fixing elements comprises a concrete block.

13. The net of claim 11, wherein at least one of said fixing elements comprises a fastening plate configured to be anchored in the ground.

14. The net of claim 10, wherein said stabilizers are configured to penetrate ground below said arched region.

15. The net of claim 10, further comprising stabilizers engaging with said loop portion of said loops and being configured to exert a downward holding force on said loops.

16. A security net for erecting in or on water or on the ground, comprising:

a bendable net comprising a mesh of wire material, rope material, strand material or plastic, said net having an arched region at a bottom, and upwardly extending regions opposite one another each on a respective side of said arched region, said regions opposite one another including longitudinal flanks of said net that are connected to one another along an overlapping portion, said net being substantially vertical;

stabilizers engaging with said arched region and configured to exert a downward holding force on said net to maintain said net in or on water or on the ground; and at least one support coupled at an upper end to said connected longitudinal flanks to thereby support an upper region of said net.

17. A security net for erecting in or on water or on the ground, comprising:

a bendable net comprising a mesh of wire material, rope material, strand material or plastic, said net having an arched region at a bottom, and upwardly extending regions opposite one another each on a respective side of said arched region, said regions opposite one another including longitudinal flanks of said net, said longitudinal flanks having an overlapping portion between an upper longitudinal edge of said net and a line parallel to said upper longitudinal edge, said net including a vertically extending region including said overlapping portion of said longitudinal flanks and a region from an upper edge of said overlapping portion of said longitudinal flanks to an upper edge of said net; and stabilizers engaging with said arched region and configured to exert a downward holding force on said net to maintain said net in or on water or on the ground.

18. The net of claim 17, further comprising fastening elements that fasten said opposed regions of said net together to thereby provide rigidity in a longitudinal plane for the vertically extending region of said net.

* * * * *